US007245048B2

(12) United States Patent
Fujii et al.

(10) Patent No.: US 7,245,048 B2
(45) Date of Patent: Jul. 17, 2007

(54) TACTILE PANEL

(75) Inventors: Noboru Fujii, Shinagawa (JP); Shinichiro Akieda, Shinagawa (JP); Junichi Akama, Shinagawa (JP); Akio Nakamura, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 27 days.

(21) Appl. No.: 11/191,135

(22) Filed: Jul. 28, 2005

(65) Prior Publication Data

US 2006/0022536 A1 Feb. 2, 2006

(30) Foreign Application Priority Data

Jul. 29, 2004 (JP) ..... 2004-221660

(51) Int. Cl.
*H20K 41/00* (2006.01)

(52) U.S. Cl. ..... 310/12; 310/13; 310/15; 345/157; 156/73.1

(58) Field of Classification Search ..... 310/12, 310/13, 15; 345/157; 156/73.1
See application file for complete search history.

(56) References Cited

U.S. PATENT DOCUMENTS 6,107,703 A * 8/2000 Korenaga ..... 310/12
6,114,781 A * 9/2000 Hazelton et al. ..... 310/12
6,130,490 A * 10/2000 Lee ..... 310/12
6,469,692 B2 * 10/2002 Rosenberg ..... 345/161
6,563,487 B2 * 5/2003 Martin et al. ..... 345/156
6,824,277 B2 * 11/2004 Freitag et al. ..... 359/507
6,972,499 B2 * 12/2005 Emoto ..... 310/12

FOREIGN PATENT DOCUMENTS

JP 2001-333493 11/2001

* cited by examiner

*Primary Examiner*—Darren Schuberg
*Assistant Examiner*—Iraj A. Mohandesi
(74) *Attorney, Agent, or Firm*—Staas & Halsey LLP

(57) ABSTRACT

A tactile panel includes a vibration panel, a yoke provided to face the vibration panel, drive coils secured on a circumference of the vibration panel, and a set of permanent magnets arranged between the vibration panel and the yoke. The vibration panel is held by panel holding members, into which both sides of the vibration panel are inserted in a direction substantially perpendicular to a vibration direction of the vibration panel.

13 Claims, 3 Drawing Sheets

TACTILE PANEL

BACKGROUND OF THE INVENTION

1. Field of the Invention

This invention generally relates to tactile panels, and more particularly, to a tactile panel that can prevent a decrease in a thrust force of a vibration panel and that can be assembled readily.

2. Description of the Related Art

FIG. 1 schematically shows a conventional tactile panel, also known as a haptic panel. FIG. 1 schematically shows a configuration of the conventional tactile panel, and is also an exploded perspective view of constructional members of the tactile panel. Referring to FIG. 1, a reference numeral 11 denotes an upper frame and a reference numeral 12 denotes a lower frame. Other members such as a vibration panel 13, as will be described later, are sandwiched and secured by the upper panel 11 and the lower panel 12 from top and bottom so as to form one unit.

A drive coil 14 is provided just below the vibration panel 13, and is bonded to the circumference of the vibration panel 13 as goes around the circumference thereof. A current is passed through the drive coil 14 to generate the thrust force in the vibration panel 13.

A rectangular shape of the vibration panel 13, to which the drive coil 14 is adhered, is secured by upper vibration panel holding members 15*a* and 15*b* from the top and by lower vibration panel holding members 16*a* and 16*b* from the bottom. The upper vibration panel holding members 15*a* and 15*b* and lower vibration panel holding members 16*a* and 16*b* are respectively arranged near rims of short sides of the rectangular shape of the vibration panel 13.

Immediately below the lower vibration panel holding members 16*a* and 16*b*, a pair of permanent magnets 17*a* and 17*b* are respectively provided on yokes 18*a* and 18*b*. Each of the permanent magnets 17*a* and 17*b* includes two permanent magnets, one of which has North Pole facing the vibration panel 13, and the other has South Pole facing the vibration panel 13. The panel is assembled by piercing bolts or the like on mounting holes 11*a* through 11*d* provided on four corners on the circumference of the upper frame 11 and mounting holes 12*a* through 12*d* provided on four corners on the circumference of the lower frame 12.

Generally, a soft elastic material such as sponge or rubber is employed in the vibration panel holding member of the conventional tactile panel so as not to decrease the thrust force of the vibration panel. Nevertheless, as far as the vibration panel is pushed and secured from top and bottom, the thrust force is inevitably absorbed by the vibration panel holding members every time the vibration panel vibrates up and down. This results in a problem in that the effective thrust force that contributes to the vibration is degraded.

Japanese Patent Application Publication No. 2001-333493 (hereinafter referred to as Document 1) discloses a plane speaker that does not disturb free vibrations of the vibration film. A crystal liquid polymer film is used for a material of the vibration film to suppress the expansion coefficient. A shock-absorbing sheet is attached to the pole face on the opposite side of the yoke of a permanent magnet to provide a gap between the shock-absorbing sheet and the vibration film. On the above-mentioned plane speaker, however, a set of the permanent magnet and the spiral coil are arranged almost uniformly on the vibration film. The structure thereof is different from that of the vibration panel shown in FIG. 1, which includes the tactile panel having the drive coil on the circumference of the vibration panel. Therefore, the technique disclosed in Document 1 cannot be applied to the prevention of the decrease in the thrust force of the vibration panel.

A pair of N pole and S pole of permanent magnets (and the yokes provided correspondingly) and the drive coil have to be arranged in a given positional relationship in order to give a given thrust force to the vibration panel. The configuration shown in FIG. 1, however, does not include a method of positioning the pair of permanent magnets. Thus, there arises another problem in that it is not easy to arrange the pair of permanent magnets at optimal positions and the assembling process also becomes complicated.

SUMMARY OF THE INVENTION

The present invention has been made in view of the above-mentioned circumstances and provides a tactile panel that can prevent the decrease in a thrust force of a vibration panel and that can be assembled readily.

According to an aspect of the present invention, preferably, there is provided a tactile panel including a vibration panel, a yoke provided to face the vibration panel, drive coils secured on a circumference of the vibration panel, and a set of permanent magnets arranged between the vibration panel and the yoke. The vibration panel is held by panel holding members, into which both sides of the vibration panel are inserted in a direction substantially perpendicular to a vibration direction of the vibration panel.

BRIEF DESCRIPTION OF THE DRAWINGS

Preferred embodiments of the present invention will be described in detail with reference to the following drawings, wherein.

DESCRIPTION OF THE PREFERRED EMBODIMENTS

A description will now be given, with reference to the accompanying drawings, of embodiments of the present invention.

Figure 1:
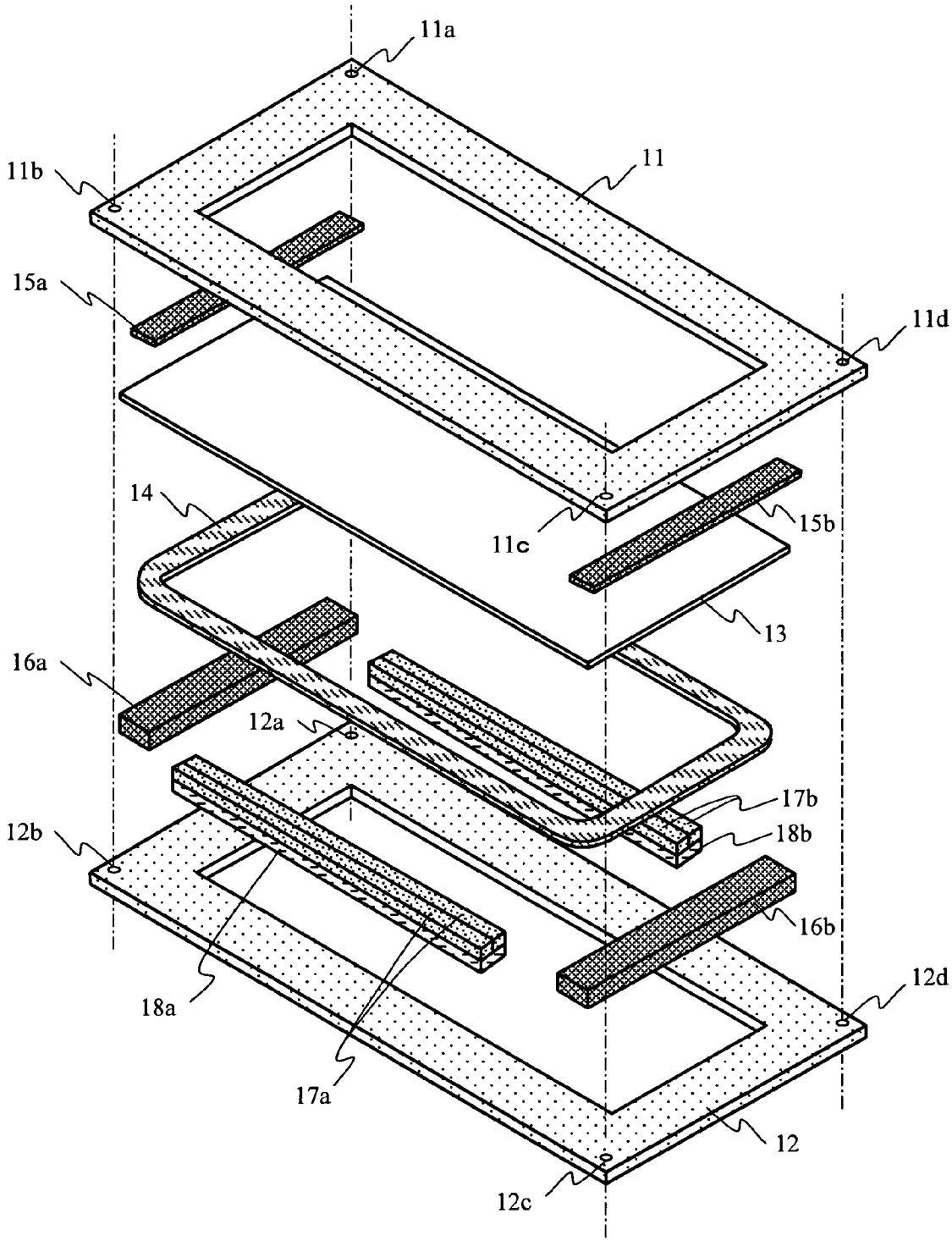
FIG. 1 schematically shows a conventional tactile panel, and is also an exploded perspective view of constructional members of the tactile panel.
Figure 2:
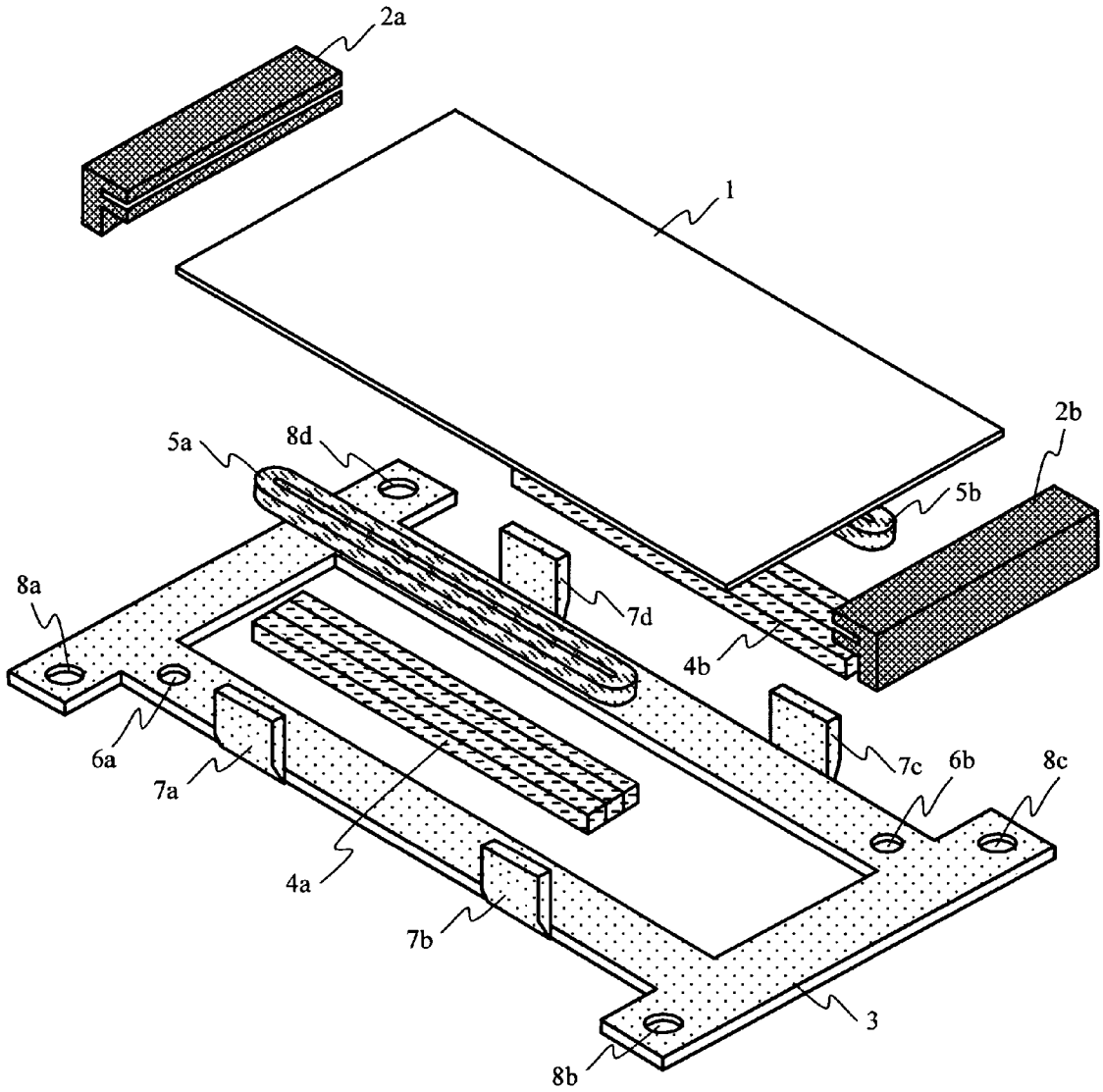
FIG. 2 schematically shows a tactile panel in accordance with the present invention, and is also an exploded perspective view of constructional members of the tactile panel.

FIG. 2 schematically illustrates a tactile panel of the present invention, is also an exploded perspective view of constructional members of the tactile panel. A vibration panel 1 is a plane plate of a rectangular shape. The vibration panel 1 is inserted into panel holding members 2*a* and 2*b* so that the panel holding members 2*a* and 2*b* can hold rims on short sides of the vibration panel 1. The panel holding members 2*a* and 2*b* are adhered and secured to given positions of a magnetic yoke 3. The panel holding members 2*a* and 2*b* hold the vibration panel in a direction perpendicular to the vibration direction. The panel holding members 2*a* and 2*b* are made of an elastic material as represented by a rubber such as nitrile rubber. The elastic material is employed so as not to decrease the thrust force applied to the vibration panel 1.

The yoke 3 is formed into a single unit according to the size of the circumference of the vibration panel 1. The yoke 3 has a rectangular opening in the inside thereof. That is, the yoke 3 is provided to surround the rectangular opening. The panel holding members 2*a* and 2*b* are secured to given positions on short sides of the vibration panel 1, which face each other through the rectangular opening. Two sets of permanent magnets 4*a* and 4*b* are arranged on given positions on long sides of the vibration panel 1, which face each other through the rectangular opening. Drive coils 5*a* and 5*b* directly secured to the vibration panel 1 are respectively arranged between the sets of permanent magnets 4*a* and 4*b* and the vibration panel 1.

Each of the permanent magnets 4*a* and 4*b* includes two bar-shaped N pole permanent magnets that face the vibration panel 1 and one bar-shaped S pole permanent magnet that faces the vibration panel 1 that are alternately arranged. The permanent magnets 4*a* and 4*b* interact with the drive coils 5*a* and 5*b* to apply the thrust force to the vibration panel 1 on the basis of the electromagnetism. Each set of the permanent magnets includes three bar-shaped permanent magnets in which two bar-shaped N pole permanent magnets facing the vibration panel and one bar-shaped S pole permanent magnet facing the vibration panel are alternately arranged, or the three bar-shaped permanent magnets in which two bar-shaped S pole permanent magnets facing the vibration panel and one bar-shaped N pole permanent magnet facing the vibration panel are alternately arranged.

As shown in FIG. 2, the tactile panel in accordance with the present invention is held by the panel holding members 2*a* and 2*b* from both short sides instead of from top and bottom of the vibration directions of the vibration panel 3. This can prevent the decrease in the thrust power. In addition, the yokes are made into a single yoke 3 having the rectangular opening in the center thereof as the yoke 3 goes around the circumference, whereas conventionally yokes are provided for the respective sets of permanent magnets. Further, the yoke 3 is capable of holding and securing the vibration panel and is also capable of arranging the set of permanent magnets thereon, although the lower frame of the conventional technique holds and secures the vibration panel, and arranges the set of permanent magnets thereon. Moreover, the short sides of the vibration panel are held by the holding members. The upper frame can be eliminated in accordance with the present invention. The above-mentioned configuration is capable of simplify the panel structure and reduce the number of the constructional members included in the tactile panel.

Figure 3:
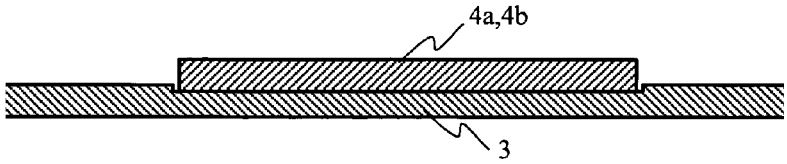
FIG. 3 illustrates a case where a shape of groove is employed in a magnet positioning portion.

Further, the tactile panel in accordance with the present invention includes magnet positioning portions 6*a* and 6*b* to arrange the pair of permanent magnets 4*a* and 4*b* properly on given areas on long sides of the yoke 3. The magnet positioning portions 6*a* and 6*b* may include uneven portions having dents and protrusions, for example. The magnet positioning portions 6*a* and 6*b*, however, is not limited to the shapes thereof, as far as the permanent magnets 4*a* and 4*b* can be positioned optimally for the drive coils 5*a* and 5*b* required for applying a given thrust force to the vibration panel 1. For example, referring to FIG. 3, a recess may be made by press forming so as to correspond to the sizes of the permanent magnets and arrange the permanent magnets in the recess.

The magnet positioning portions 6*a* and 6*b* are provided in this manner, and the permanent magnets 4*a* and 4*b* can be positioned accurately on the optimal positions on the yoke 3. Additionally, the drive coils 5*a* and 5*b* and the permanent magnets 4*a* and 4*b* are not misaligned from the optimal positions any longer not only while the tactile panel is being assembled but also after the tactile panel is assembled. This can prevent the decrease in the thrust force of the vibration panel 1 caused by the misalignment.

Upstanding sidewalls are provided on rims of the long sides of the yoke 3. These sidewalls are panel position control portions 7*a* through 7*d*. The panel position control portions 7*a* through 7*d* prevent the vibration panel 1 from misaligning in a lateral direction. Also, assembling secure portions 8*a* through 8*d* are provided on the short sides of the yoke 3. The assembling secure portions 8*a* through 8*d* make it possible to attach an assembled tactile panel directly to an external device such as a display, and makes the assembling process easy. The assembling secure portions 8*a* through 8*d* are shown as openings, yet the assembling secure portions 8*a* through 8*d* may be cutouts or have any other structure.

As described, the tactile panel in accordance with the present invention has the single yoke 3 into which multiple yokes are unified. The magnet positioning portions 6*a* and 6*b*, the panel position control portions 7*a* through 7*d*, and the assembling secure portions 8*a* through 8*d* are arranged together on the single yoke 3. It is thus possible to reduce the number of structural members, and in addition, the workability in the assembling process can be improved.

Figure 4A:
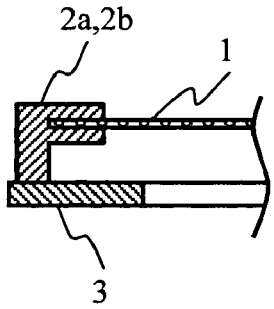
FIGS. 4A through 4D illustrate examples of shapes of bonding members included in the tactile panel in accordance with the present invention.
Figure 4B:
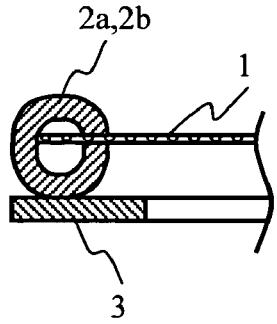
Figure 4C:
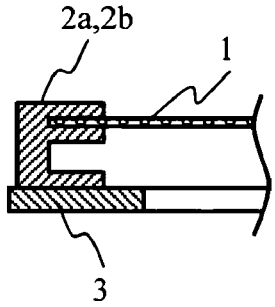
Figure 4D:
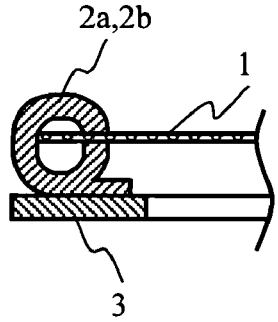

Referring to FIG. 4A, cross-sectional shapes of the panel holding members 2*a* and 2*b* have a substantially F shape, as also shown in FIG. 2. This shape is not limited to the H shape, and any other shape such as a substantially C shape may be employed as shown in FIG. 4B. Even if the above-mentioned shape is employed, the elastic material is always selected. The elastic material is represented by rubber such as nitrile rubber. If a bonding area is small between the yoke 3 and one of the panel holding members 2*a* and 2*b* resulting in an unstable bonding, the bottom of the panel holding member may be configured to have a large bonding area between the yoke 3, as shown in FIGS. 4C and 4D.

In the embodiment mentioned above, the two sets of permanent magnets 4*a* and 4*b* are described, yet one set of permanent magnets may be provided.

As described, the present invention can provide the tactile panel that can be assembled readily and that can prevent the decrease in the thrust force of the vibration panel.

The present invention is not limited to the above-mentioned embodiment, and other embodiments, variations and modifications may be made without departing from the scope of the present invention.

The present invention is based on Japanese Patent Application No. 2004-221660 filed on Jul. 29, 2004, the entire disclosure of which is hereby incorporated by reference.

What is claimed is:

1. A tactile panel comprising:

a vibration panel;

a yoke facing the vibration panel;

drive coils secured on a circumference of the vibration panel; and a set of permanent magnets between the vibration panel and the yoke; and panel holding members, separate from the vibration panel, into which opposite sides of the vibration panel are inserted, in a direction substantially perpendicular to a vibration direction of the vibration panel, to hold the vibration panel.

2. A tactile panel, comprising:

a vibration panel;

a yoke facing the vibration panel;

drive coils secured on a circumference of the vibration panel;

a set of permanent magnets between the vibration panel and the yoke; and panel holding members into which opposite sides of the vibration panel are inserted, in a direction substantially perpendicular to a vibration direction of the vibration panel, to hold the panel; and the yoke comprises a single yoke, having a rectangular opening in a center thereof, disposed on the circumference of the vibration panel.

3. The tactile panel as claimed in claim 2, wherein the panel holding members are directly secured to the yoke.

4. The tactile panel as claimed in claim 2, wherein the set of permanent magnets is disposed directly on the yoke and facing the drive coils.

5. The tactile panel as claimed in claim 1, further comprising:

first and second sets of permanent magnets between the vibration panel and the yoke; and first and second drive coils secured on the surface of the vibration panel and respectively corresponding to said two sets of permanent magnets.

6. A tactile panel, comprising:

a vibration panel;

a yoke facing the vibration panel;

drive coils secured on a circumference of the vibration panel;

a set of permanent magnets between the vibration panel and the yoke; and panel holding members into which opposite sides of the vibration panel are inserted, in a direction substantially perpendicular to a vibration direction of the vibration panel, to hold the panel; and the set of permanent magnets comprises three bar-shaped permanent magnets, of which two bar-shaped N pole permanent magnets, facing the vibration panel, and are alternately arranged with one bar-shaped S pole permanent magnet, facing the vibration panel, are alternately arranged, or the three bar-shaped permanent magnets, of which two bar-shaped S pole permanent magnets, facing the vibration panel, and are alternately arranged with one bar-shaped N pole permanent magnet, facing the vibration panel.

7. A tactile panel, comprising:

a vibration panel;

a yoke facing the vibration panel;

drive coils secured on a circumference of the vibration panel;

a set of permanent magnets arranged between the vibration panel and the yoke, and panel holding members into which opposite sides of the vibration panel are inserted, in a direction substantially perpendicular to a vibration direction of the vibration panel, to hold the vibration panel, wherein each of the panel holding members has a cross-sectional F shape or C shape.

8. A tactile panel, comprising:

a vibration panel;

a yoke facing the vibration panel;

drive coils secured on a circumference of the vibration panel;

a set of permanent magnets arranged between the vibration panel and the yoke; and panel holding members into which opposite sides of the vibration panel are inserted, in a direction substantially perpendicular to a vibration direction of the vibration panel, to hold the vibration panel, wherein the panel holding members are made of an elastic material.

9. The tactile panel as claimed in claim 1, wherein the yoke includes panel position control portions that control a position of the vibration panel.

10. The tactile panel as claimed in claim 7, wherein the panel position control portions are upstanding sidewalls provided on rims of the yoke.

11. The tactile panel as claimed in claim 1, wherein the yoke includes magnet positioning portions to position said at least one pair of the permanent magnets.

12. The tactile panel as claimed in claim 8, wherein the magnet positioning portions are recesses provided in areas that correspond to sizes of the permanent magnets.

13. The tactile panel as claimed in claim 1, wherein the yoke includes assembling secure portions to attach the tactile panel to an external device.

* * * * *